US011244779B2

(12) United States Patent
Fujiwara et al.

(10) Patent No.: US 11,244,779 B2
(45) Date of Patent: Feb. 8, 2022

(54) R-T-B BASED PERMANENT MAGNET

(71) Applicant: TDK Corporation, Tokyo (JP)

(72) Inventors: Mariko Fujiwara, Tokyo (JP); Makoto Iwasaki, Tokyo (JP)

(73) Assignee: TDK CORPORATION, Tokyo (JP)

( * ) Notice: Subject to any disclaimer, the term of this patent is extended or adjusted under 35 U.S.C. 154(b) by 0 days.

(21) Appl. No.: 16/823,997

(22) Filed: Mar. 19, 2020

(65) Prior Publication Data

US 2020/0303099 A1 Sep. 24, 2020

(30) Foreign Application Priority Data

Mar. 20, 2019 (JP) ..... JP2019-053653

(51) Int. Cl.
*H01F 1/057* (2006.01)
*C22C 30/02* (2006.01)

(52) U.S. Cl.
CPC ..... *H01F 1/057* (2013.01); *C22C 30/02* (2013.01); *C22C 2202/02* (2013.01)

(58) Field of Classification Search
None
See application file for complete search history.

(56) References Cited

U.S. PATENT DOCUMENTS

2004/0177899 A1 9/2004 Nishizawa et al.

FOREIGN PATENT DOCUMENTS

JP 2014-027268 A 2/2014
JP 2016184735 * 10/2016
WO 2004/029996 A1 4/2004

OTHER PUBLICATIONS

English language machine translation of JP2016184735. Generated Mar. 25, 2021. (Year: 2021).*

* cited by examiner

*Primary Examiner* — Brian D Walck
(74) *Attorney, Agent, or Firm* — Oliff PLC

(57) ABSTRACT

The object of the present invention is to provide an R-T-B based permanent magnet having a wide temperature range suitable for sintering. The R-T-B based permanent magnet in which R is one or more rare earth elements, T is a combination of Fe and Co, and B is boron. The R-T-B based permanent magnet comprises M, O, C, and N. M is three or more selected from Cu, Ga, Mn, Zr, and Al; and at least comprises Cu, Ga, and Zr. A content of each component is within a predetermined range. The R-T-B based permanent magnet includes main phase grains made of $R_2T_{14}B$ compound and grain boundaries existing between main phase grains. The grain boundaries include a two-grain boundary which is a grain boundary formed between two adjacent main phase grains, and a Zr—B compound is included in the two-grain boundary.

10 Claims, 1 Drawing Sheet

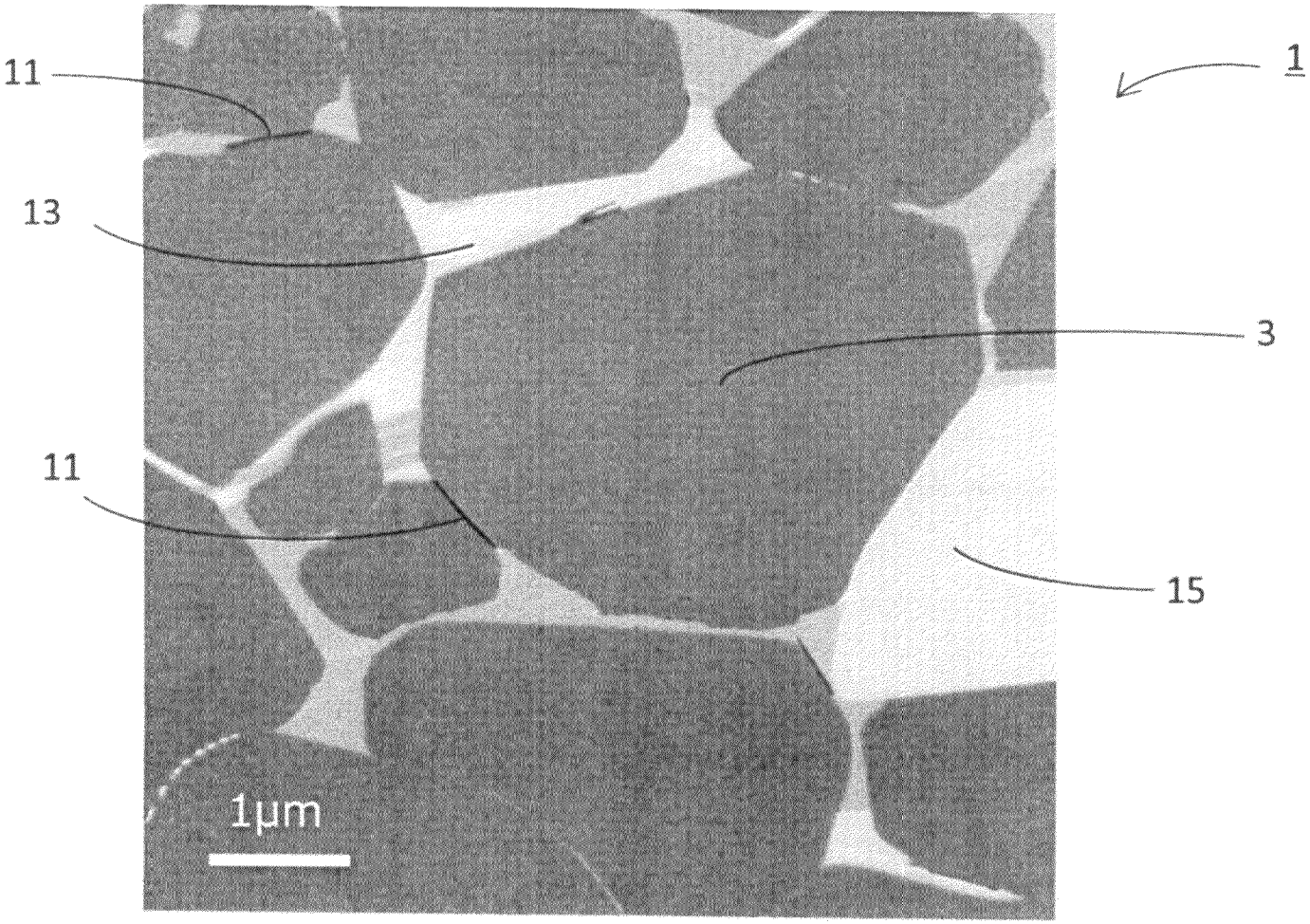
1
3
15
11
13
11
1μm

R-T-B BASED PERMANENT MAGNET

TECHNICAL FIELD

The present invention relates to an R-T-B based permanent magnet.

BACKGROUND

Patent Document 1 discloses that a sintered magnet having high coercive force, squareness ratio, and bending strength, even when contents of heavy rare earth elements are decreased, can be obtained by forming phases including Zr, B, and C.

Patent Document 2 discloses that an R-T-B based rare earth permanent magnet having a wide sintering temperature range capable of restricting a grain growth while maintaining high magnetic properties can be obtained by having a plate shape or a needle shape product in grain boundary phases.

[Patent Document 1] JP Patent Application Laid Open No. 2014-027268

[Patent Document 2] WO 2004/029996

SUMMARY

An object of the present invention is to provide an R-T-B based permanent magnet having a wide temperature range suitable for sintering while having a low B content.

In response to the above issue, it is an object of the present invention to provide an R-T-B based permanent magnet in which R is one or more rare earth elements, T is a combination of Fe and Co, and B is boron, wherein the R-T-B based permanent magnet includes M, O, C, and N, M is three or more selected from Cu, Ga, Mn, Zr, and Al, and M at least comprises Cu, Ga, and Zr, with respect to 100 mass % of the R-T-B based permanent magnet, a total content of R is 29.0 mass % or more and 33.5 mass % or less, Co content is 0.10 mass % or more and 0.49 mass % or less, B content is 0.80 mass % or more and 0.96 mass % or less, a total content of M is 0.63 mass % or more and 4.00 mass % or less, Cu content is 0.51 mass % or more and 0.97 mass % or less, Ga content is 0.12 mass % or more and 1.07 mass % or less, Zr content is 0.80 mass % or less (does not include 0 mass %), C content is 0.065 mass % or more and 0.200 mass % or less, N content is 0.023 mass % or more and 0.323 mass % or less, O content is more than 0.200 mass % and 0.500 mass % or less, Fe is a substantial balance, and the R-T-B based permanent magnet includes main phase grains made of $R_2T_{14}B$ compound and a two-grain boundary which is a grain boundary formed between two adjacent main phase grains, and a Zr—B compound is included in the two-grain boundary.

The R-T-B based permanent magnet according to the present invention becomes an R-T-B based permanent magnet having a wide temperature range suitable for sintering by satisfying the above-mentioned properties.

The temperature range suitable for sintering may be a temperature range capable of obtaining a sufficiently high squareness ratio without having an abnormal grain growth even after sintering. Hereinafter, the temperature range suitable for sintering may be simply referred as a sintering temperature range.

The R-T-B based permanent magnet according to the present invention may further include an R—O—C—N concentrated part.

The R-T-B based permanent magnet according to the present invention may further include an R—Ga—Co—Cu—N concentrated part.

The R-T-B based permanent magnet according to the present invention may not substantially include a Zr—C compound.

BRIEF DESCRIPTION OF THE DRAWINGS

FIG. 1 shows a SEM image of the R-T-B based permanent magnet according to the present embodiment.

DETAILED DESCRIPTION

Hereinafter, the present invention is described based on an embodiment shown in the FIGURE.

<R-T-B Based Permanent Magnet>

The R-T-B based permanent magnet 1 according to the present embodiment is described using the FIGURE. The FIGURE is a SEM image of a cross section of the R-T-B based permanent magnet 1 (Sample No. 1 which is described in below) according to the present embodiment which is observed at a magnification of 10000×. The R-T-B based permanent magnet 1 according to the present embodiment includes main phase grains 3 made of a crystal grain having an $R_2T_{14}B$ type crystal structure (R is at least one selected from rare earth elements, T is a combination of Fe and Co, and B is boron), and grain boundaries formed between adjacent two or more main phase grains 3.

An average grain size of the main phase grains 3 is usually 1 μm to 30 μm or so.

The grain boundaries include a two-grain boundary which is formed between adjacent two main phase grains 3 and a grain boundary multiple junction which is a grain boundary surrounded by three or more main phase grains 3. In the R-T-B based permanent magnet 1 according to the present embodiment, a Zr—B compound 11 is included in the two-grain boundary. A type of the Zr—B compound 11 is not particularly limited, and it is mainly $ZrB_2$ compound. $ZrB_2$ compound has an $AlB_2$ type hexagonal crystal structure.

Therefore, as shown in the FIGURE, the Zr—B compound 11 forms a needle shape having an extremely large long diameter—short diameter ratio (long diameter/short diameter). Extremely large long diameter—short diameter ratio means, for example, long dimeter/short diameter of 25 or more and 250 or less. The Zr—B compound 11 tends to distribute along the main phase grains 3, and particularly it tends to be included in the two-grain boundary.

In the R-T-B based permanent magnet 1 according to the present embodiment, the Zr—B compound 11 is included in the two-grain boundary, thereby the abnormal grain growth is restricted even in case of sintering at a high temperature.

The abnormal grain growth is restricted by the Zr—B compound 11 included in the two-grain boundary because the Zr—B compound 11 prevents exchange of element between the adjacent two main phase grains 3.

Since the R-T-B based permanent magnet 1 includes the Zr—B compound 11 in the two-grain boundary, even in case of sintering at a high temperature to attain a sufficiently high squareness ratio Hk/HcJ, the R-T-B based permanent magnet 1 with restricted abnormal grain growth can be obtained. Further, a permanent magnet having a high Hk/HcJ can be produced stably in a wider sintering temperature range. That is, the R-T-B based permanent magnet 1 according to the present embodiment attains a wider sintering temperature range.

The R-T-B based permanent magnet 1 according to the present embodiment may have an R—O—C—N concentrated part 15 having higher concentrations of R, O, C, and N in the grain boundary multiple junction than in the main phase grains 3. The R—O—C—N concentrated part 15 may include other elements besides R, O, C, and N, and the R—O—C—N concentrated part 15 may have a cubic type crystal structure. The R—O—C—N concentrated part 15 included in the R-T-B based permanent magnet 1 according to the present embodiment may have C content of 30 atom % or more.

When the composition of the R-T-B based permanent magnet 1 is within a specific range, the R—O—C—N concentrated part 15 tends to be easily included. When the R—O—C—N concentrated part 15 is included in the R-T-B based magnet 1, the R—O—C—N concentrated part 15 includes large amount of C, and C content in parts other than the R—O—C—N concentrated part 15 decreases. Therefore, the Zr—B compound 11 tends to be easily formed in the R-T-B based permanent magnet 1. In case an area ratio of the R—O—C—N concentrated part 15 occupies 1% or more of the cross section of the R-T-B based permanent magnet 1, the Zr—B compound 11 tends to be easily formed. However, when the above-mentioned area ratio is 5% or more, Br tends to easily decrease. Also, the R—O—C—N concentrated part 15 tends to be formed easily when the contents of O, C, and N increase.

The R-T-B based permanent magnet 1 according to the present embodiment may have an R—Ga—Co—Cu—N concentrated part 13 having higher concentrations of R, Ga, Co, Cu, and N in the grain boundary multiple junction than in the main phase grains 3. The Zr—B compound 11 may not be formed in the R—Ga—Co—Cu—N concentrated part 13. The R—Ga—Co—Cu—N concentrated part 13 may include other elements besides R, Ga, Co, Cu, and N.

When the composition of the R-T-B based permanent magnet 1 is within a specific range, the R—O—C—N concentrated part 15 and the R—Ga—Co—Cu—N concentrated part 13 tend to be easily included.

As shown in the FIGURE, the R—O—C—N concentrated part 15 and the R—Ga—Co—Cu—N concentrated part 13 are included in the grain boundary multiple junction. The Zr—B compound 11 is less likely to be formed in the R—O—C—N concentrated part 15 and the R—Ga—Co—Cu—N concentrated part 13. By occupying many grain boundary multiple junctions with the R—O—C—N concentrated part 15 and the R—Ga—Co—Cu—N concentrated part 13, the Zr—B compound 11 tends to be easily formed in the two-grain boundary and tends to be distributed along the main phase grains 3. Note that, when the R—Ga—Co—Cu—N concentrated part 13 is not included, a Fe-rich phase and an R-rich phase tend to be easily formed instead. The Fe-rich phase and the R-rich phase do not interfere the Zr—B compound from distributing into the grain boundary multiple junction, thus the Zr—B compound tends to be easily distributed in the grain boundary multiple junction and is less likely to be included in the two-grain boundary.

Other than the R—O—C—N concentrated part 15 and the R—Ga—Co—Cu—N concentrated part 13, the grain boundaries of the R-T-B based permanent magnet according to the present embodiment may include an R-rich phase having a higher R concentration than in the main phase grains 3, a B-rich phase having a higher B (boron) concentration than in the main phase grains 3, and the like. The grain boundaries of the R-T-B based permanent magnet according to the present embodiment may further include a Fe-rich phase, and oxides of R such as $R_2O_3$, $RO_2$, or RO. The Fe-rich phase is a phase having a higher Fe concentration than in the main phase grains 3 and has a $La_6Co_{11}Ga_3$ type crystal structure.

The R-T-B based permanent magnet 1 according to the present embodiment may not substantially include a Zr—C compound. A type of the Zr—C compound is not particularly limited, and it is mainly ZrC compound. The ZrC compound has a face-centered cubic structure (NaCl structure).

In the R-T-B based permanent magnet 1, in case Zr, B, and C are included, the Zr—C compound tends to be formed prior to the Zr—B compound 11. This is because Zr and C tend to bond easily than Zr and B. That is, when the Zr—C compound is not substantially included, the Zr—B compound 11 tends to be formed most, and the effect of restricting the abnormal grain growth is most exhibited. In case Zr content is increased to form the Zr—B compound easily, then Br tends to easily decrease.

The R—O—C—N concentrated part 15, the R—Ga—Co—Cu—N concentrated part 13, and the Zr—C compound all have a grain growth restricting effect. Also, the oxides of R have the grain growth restricting effect. These compounds and concentrated parts tend to distribute in the grain boundary multiple junction. Therefore, the grain growth restricting effect of the Zr—B compound 11 which tends to be included in the two-grain boundary is significantly high compared to other compounds and concentrated parts.

R represents at least one selected from rare earth elements. The rare earth elements include Sc, Y, and lanthanoids, which belong to a third group of a long period type periodic table. For example, the lanthanoids include La, Ce, Pr, Nd, Sm, Eu, Gd, Tb, Dy, Ho, Er, Tm, Yb, Lu, and the like. The rare earth elements are classified into light rare earth elements and heavy rare earth elements. The heavy rare earth elements include, Gb, Tb, Dy, Ho, Er, Tm, Yb, and Lu. The light rare earth element are rare earth elements other than the heavy rare earth elements. In the present embodiment, from the point of suitably controlling the production cost and the magnetic properties, Nd and/or Pr may be included as R. Also, particularly from the point of improving HcJ, the heavy rare earth elements and the light rare earth elements may be both included. A content of the heavy rare earth elements are not particularly limited, and the heavy rare earth elements may not be included. The content of the heavy rare earth elements is for example 5 mass % or less (includes 0 mass %).

A total R content of the R-T-B based permanent magnet 1 according to the present embodiment is 29.0 mass % or more and 33.5 mass % or less. When the total R content is too small, the main phase grains 3 of the R-T-B based permanent magnet 1 are not formed enough. Further, a-Fe and the like having a soft magnetic property tend to easily form and HcJ tends to easily decrease. In case the total R content is too much, a volume ratio of the main phase grains 3 of the R-T-B based permanent magnet 1 decreases and Br decreases.

B content of the R-T-B based permanent magnet 1 according to the present embodiment is 0.80 mass % or more and 0.96 mass % or less. It may be 0.85 mass % or more and 0.96 mass % or less. When B content is too small, HcJ tends to decrease. Further, the Zr—B compound 11 is less likely to be included in the two-grain boundary. As a result, in case sintering is performed under a high temperature, the abnormal grain growth tends to easily occur. In case sintering is performed under a low temperature, Hk/HcJ does not become high enough. That is, the sintering temperature range is narrowed. When B content is too much, the abnormal grain growth tends to easily occur. Further, Br decreases.

T is a combination of Fe and Co. Co content of the R-T-B based permanent magnet 1 according to the present embodiment is 0.10 mass % or more and 0.49 mass % or less. It may be 0.10 mass % or more and 0.44 mass % or less. It may be 0.20 mass % or more and 0.42 mass % or less, and may be 0.20 mass % or more and 0.39 mass % or less. In case Co content is too small, the R—Ga—Co—Cu—N concentrated part 13 is less likely to be formed. As a result, the Zr—B compound 11 tends to be easily included in the grain boundary multiple junction and is less likely to be included in the two-grain boundary. As a result, when sintering is performed under a high temperature, the abnormal grain growth tends to easily occur. When sintering is performed under a low temperature, Hk/HcJ does not become high enough. That is, the sintering temperature range is narrowed. When Co content is too much, Br and HcJ decrease. Also, the R-T-B based permanent magnet 1 according to the present embodiment tends to cost more.

The R-T-B based permanent magnet 1 according to the present embodiment further includes M. M is three or more selected from Cu, Ga, Mn, Zr, and Al; and M at least includes Cu, Ga, and Zr. A total M content is not particularly limited, and for example it may 0.63 mass % or more and 4.00 mass % or less.

Cu content of the R-T-B based permanent magnet 1 according to the present embodiment is 0.51 mass % or more and 0.97 mass % or less. It may be 0.53 mass % or more and 0.97 mass % or less. It may be 0.55 mass % or more and 0.80 mass % or less. By including Cu, even when Co content is 0.49 mass % or less, the R—Ga—Co—Cu—N concentrated part 13 is formed sufficiently. When Cu content is too small, the R—Ga—Co—Cu—N concentrated part 13 is less likely to be formed. As a result, the Zr—B compound 11 tends to be easily included in the grain boundary multiple junction and is less likely to be included in the two-grain boundary. As a result, when sintering is performed under a high temperature, the abnormal grain growth tends to easily occur. When sintering is performed under a low temperature, Hk/HcJ does not become high enough. That is, the sintering temperature range is narrowed. When Cu content is too much, Br decreases.

Ga content of the R-T-B based permanent magnet 1 according to the present embodiment is 0.12 mass % or more and 1.07 mass % or less. It may be 0.13 mass % or more and 1.06 mass % or less. It may be 0.55 mass % or more and 0.82 mass % or less. By sufficiently including Ga, even when Co content is 0.49 mass % or less, the R—Ga—Co—Cu—N concentrated part 13 is formed sufficiently. When Ga content is too small, the R—Ga—Co—Cu—N concentrated part 13 is less likely to be formed. As a result, the Zr—B compound 11 tends to be easily included in the grain boundary multiple junction and is less likely to be included in the two-grain boundary. As a result, when sintering is performed under a high temperature, the abnormal grain growth tends to easily occur. When sintering is performed under a low temperature, Hk/HcJ tends to easily decrease. That is, the sintering temperature range is narrowed. Further, HcJ also decreases. When Ga content is too much, Br decreases. As Ga content increases, a Fe-rich phase tends to be easily formed.

The R-T-B based permanent magnet 1 according to the present embodiment may include Al if needed. By including Al, even when Co content is 0.49 mass % or less, the R—Ga—Co—Cu—N concentrated part 13 is formed sufficiently. Al content is not particularly limited, and Al may not be included. For example, it may be 0.08 mass % or more and 0.41 mass % or less. It may be 0.10 mass % or more and 0.19 mass % or less. As Al content decreases, HcJ tends to easily decrease. Also, as Al content decreases, the R—Ga—Co—Cu—N concentrated part 13 is less likely to be formed. As a result, the Zr—B compound 11 tends to be easily included in the grain boundary multiple junction and is less likely to be included in the two-grain boundary. As a result, when sintering is performed under a high temperature, the abnormal grain growth tends to easily occur. When sintering is performed under a low temperature, Hk/HcJ tends to decrease easily. That is, the sintering temperature range is narrowed. As Al content increases, Br tends to easily decrease.

Zr content of the R-T-B based permanent magnet 1 according to the present embodiment is 0.80 mass % or less (does not include 0 mass %). It may be 0.15 mass % or more and 0.42 mass % or less, and 0.22 mass % or more and 0.31 mass % or less. By including Zr, the Zr—B compound 11 is formed in the two-grain boundary. Even when sintering is performed under a low temperature, the R-T-B based permanent magnet 1 having a sufficiently high Hk/HcJ can be obtained. Further, the sintering temperature range of the R-T-B based permanent magnet 1 becomes wider. When Zr is not included, the Zr—B compound 11 is not formed. As a result, when sintering is performed under a high temperature, the abnormal grain growth tends to easily occur. When sintering is performed under a low temperature, Hk/HcJ tends to easily decrease. That is, the sintering temperature range is narrowed. As Zr content increases, Br tends to easily decrease.

The R-T-B based permanent magnet 1 according to the present embodiment may include Mn if needed. By including Mn, even when Co content is 0.49 mass % or less, the R—Ga—Co—Cu—N concentrated part 13 is formed sufficiently. Mn content is not particularly limited, and Mn may not be included. Mn content is, for example, 0.02 mass % or more and 0.08 mass % or less. It may be 0.03 mass % or more and 0.05 mass % or less. As Mn content decreases, the R—Ga—Co—Cu—N concentrated part 13 is less likely to be formed. As a result, the Zr—B compound 11 tends to be easily included in the a grain boundary multiple junction and is less likely to be included in the two-grain boundary. As a result, when sintering is performed under a high temperature, the abnormal grain growth tends to easily occur. When sintering is performed under a low temperature, Hk/HcJ tends to easily decrease. That is, the sintering temperature range is narrowed. As Mn content increases, Br and HcJ tends to easily decrease.

The R-T-B based permanent magnet 1 according to the present embodiment includes O, C, and N.

In the R-T-B based permanent magnet 1 according to the present embodiment, an oxygen amount is more than 0.200 mass % and 0.500 mass % or less. It may be 0.201 mass % or more and 0.367 mass % or less. When the oxygen amount is 0.200 mass % or less, the R—O—C—N concentrated part 15 is not formed. As a result, the Zr—B compound 11 is not formed. As a result, when sintering is performed under a high temperature, the abnormal grain growth tends to easily occur. When sintering is performed under a low temperature, Hk/HcJ tends to easily decrease. That is, the sintering temperature range is narrowed. When the oxygen amount is too much, HcJ tends to easily decrease.

In the R-T-B based permanent magnet 1 according to the present embodiment, a carbon amount is 0.065 mass % or more and 0.200 mass % or less. It may be 0.073 mass % or more and 0.202 mass % or less, and 0.076 mass % or more and 0.105 mass % or less. When the carbon amount is too small, the R—O—C—N concentrated part 15 is not formed. As a result, the Zr—C compound is formed prior to the Zr—B compound 11, and the Zr—B compound is not formed. When the carbon amount is too large, the Zr—C compound is formed prior to the Zr—B compound 11, and the Zr—B compound is not formed. That is, in case the carbon amount is either too small or too large, the Zr—B compound 11 is not formed, and when sintering is performed under a high temperature, the abnormal grain growth tends to easily occur. When sintering is performed under a low temperature, Hk/HcJ tends to easily decrease. That is, the sintering temperature range is narrowed. Also, when the carbon amount is too small or too large, HcJ decreases.

In the R-T-B based permanent magnet 1 according to the present embodiment, a nitrogen amount is 0.023 mass % or more and 0.323 mass % or less. It may be 0.035 mass % or more and 0.096 mass % or less, and 0.054 mass % or more and 0.096 mass % or less. By having the nitrogen amount within the above-mentioned range, the R—Ga—Co—Cu—N concentrated part 13 tends to easily form in the grain boundaries. When the nitrogen amount is too small, the R—Ga—Co—Cu—N concentrated part 13 is less likely to be formed. As a result, the Zr—B compound 11 tends to be easily included in the grain boundary multiple junction and is less likely to be included in the two-grain boundary. As a result, when sintering is performed under a high temperature, the abnormal grain growth tends to easily occur. When sintering is performed under a low temperature, Hk/HcJ tends to easily decrease. That is, the sintering temperature range is narrowed. When the nitrogen amount is too large, HcJ decreases.

A method of adding nitrogen in the R-T-B based permanent magnet 1 is not particularly limited, and for example nitrogen may be introduced by heat treating a raw material alloy under nitrogen gas atmosphere of predetermined concentration as described in below. Alternatively, for example, an auxiliary agent including nitrogen such as urea and the like may be used as a pulverization aid. Other than this, nitrogen may be introduced in the grain boundaries of the R-T-B based permanent magnet 1 by using a compound including nitrogen as a treating agent of the raw material alloy.

The oxygen amount, carbon amount, and nitrogen amount in the R-T-B based permanent magnet 1 can be measured by methods generally known. For example, the oxygen amount is measured by an inert gas fusion-nondispersive infrared absorption method; the carbon amount is measured by a combustion in oxygen stream-infrared absorption method; and the nitrogen amount is measured by an inert gas fusion-thermal conductivity method.

Fe content of the R-T-B based permanent magnet 1 according to the present embodiment is substantially a balance of constituting elements of the R-T-B based permanent magnet 1. By referring that "Fe content is substantially a balance", for example, it means that a total content other than the above-mentioned elements R, B, T, M, O, C, and N is 1 mass % or less.

The R-T-B based permanent magnet 1 according to the present embodiment is processed into an arbitrary shape for use. The shape of the R-T-B based permanent magnet 1 according to the present embodiment is not particularly limited, and for example, a columnar shape such as a rectangular parallelepiped shape, a hexahedron shape, a tabular shape, a square pole shape, and the like; a cylinder shape of which a cross section shape of the R-T-B based permanent magnet 1 is C-shaped, and the like may be mentioned.

The R-T-B based permanent magnet 1 according to the present embodiment includes both a magnet product which has been processed and magnetized, and a magnet product which has not been magnetized.

<Method of Producing R-T-B Based Permanent Magnet>

An example of method of producing the R-T-B based permanent magnet according to the present embodiment having the above-mentioned constitution is described. The method of producing the R-T-B based permanent magnet (R-T-B based sintered magnet) according to the present embodiment includes following steps:

(a) an alloy preparation step preparing a raw material alloy;

(b) a pulverization step pulverizing the raw material alloy;

(c) a compacting step compacting an obtained alloy powder;

(d) a sintering step wherein a green compact is sintered to obtain the R-T-B based permanent magnet;

(e) an aging step carrying out an aging treatment to the R-T-B based permanent magnet;

(f) a cooling step cooling the R-T-B based permanent magnet;

(g) a machining step wherein the R-T-B based permanent magnet is machined;

(h) a grain boundary diffusion step wherein a heavy rare earth element is diffused into the R-T-B based permanent magnet; and (i) a surface treatment step wherein the R-T-B based permanent magnet is surface treated.

[Alloy Preparation Step]

The raw material alloy having a composition which is a base of the R-T-B based permanent magnet according to the present embodiment is prepared (alloy preparation step). In the alloy preparation step, raw material metals corresponding to the composition of the R-T-B based permanent magnet according to the present embodiment are melted in vacuum or inert gas atmosphere such as Ar gas and the like. The melted raw metals are casted to produce the raw material alloy having the desired composition. In the present embodiment, a one-alloy method is described, however a two-alloy method in which two alloys, that is a first alloy and a second alloy, are mixed to produce the raw material powder may be used.

As the raw material metals, for example, rare earth metals or alloy of rare earth metals, pure iron, ferro-boron, compounds and alloys of these, and the like can be used. As a method of casting the raw material metals, for example, an ingot casting method, a strip casting method, a book molding method, a centrifugal casting method, and the like may be mentioned. In case solidification segregation exist in the obtained raw material alloy, a homogenization treatment is carried out if needed. In case the homogenization treatment is carried out to the raw material alloy, it is carried out in vacuum or in inert gas atmosphere and held in a temperature of 700° C. or higher and 1500° C. or lower for one hour or longer. Thereby, the raw material alloy is melted and homogenized.

[Pulverization Step]

After the raw material alloy is produced, it is pulverized (pulverization step). The pulverization step includes a coarse pulverization step pulverizing until a particle size is several hundred m to several mm or so, and a fine pulverization step pulverizing until a particle size is several m or so.

(Coarse Pulverization Step)

The raw material alloy is coarsely pulverized until the particle size is several hundred m to several mm or so (coarse pulverization step). Thereby, a coarsely pulverized powder of the raw material alloy is obtained. After hydrogen is stored in the raw material alloy, hydrogen is released due to a different hydrogen storage amount between different phases, and dehydrogenation is carried out which causes a self-collapsing like pulverization (hydrogen storage pulverization), thereby the coarse pulverization can be carried out.

The added amount of nitrogen necessary for forming the R—Ga—Co—Cu—N concentrated part can be regulated by adjusting the nitrogen gas concentration in the atmosphere of the dehydrogenation treatment during the hydrogen storage pulverization. An optimum nitrogen gas concentration differs depending on the composition of the raw material alloy and the like. It may be 300 ppm or more.

Other than the above-mentioned hydrogen storage pulverization, the coarse pulverization step may be carried out by using a coarse pulverizer such as a stamp mill, a jaw crusher, a brown mill, and the like, in inert gas atmosphere.

The oxygen concentration is adjusted by regulating the atmosphere of each step of production. From the point of obtaining high magnetic properties, the oxygen amount of the R-T-B based permanent magnet obtained at the end may be reduced. In order to attain this, the oxygen concentration of each step from the pulverization step to the sintering step described in below may be 100 ppm or less.

From the point of making the sintering temperature range of the R-T-B based permanent magnet wider, the oxygen concentration may be within a specific range, particularly by regulating the time for finely pulverizing the coarsely pulverized powder and by regulating the oxygen concentration in the atmosphere relatively high. The oxygen amount of the R-T-B based permanent magnet obtained at the end may be within a specific range, particularly it may be larger than 0.200 mass %. For example, the time for finely pulverizing the coarsely pulverized powder may be 10 minutes to 6 hours, and the oxygen concentration in the atmosphere may be 0.5% to 22%, and for example it may be 5% or so.

(Fine Pulverization Step)

After coarsely pulverizing the raw material alloy, the obtained coarsely pulverized powder of the raw material alloy is finely pulverized until an average particle size is several m or so (fine pulverization step). Thereby, a finely pulverized powder of the raw material alloy is obtained. By further finely pulverizing the coarsely pulverized powder, for example, the finely pulverized powder of 1 μm or more and 10 μm or less, or 3 μm or more and 5 μm or less can be obtained.

The fine pulverization is carried out by further pulverizing the coarsely pulverized powder using a fine pulverizer such as a jet mill, a ball mill, a vibrating mill, a wet attritor, and the like while regulating the condition such as a pulverization time and the like accordingly. A jet mill is a method of pulverization wherein a high pressure inert gas (for example, $N_2$ gas) is released from a narrow nozzle to generate a high speed gas flow, and this high speed gas flow accelerates the coarsely pulverized powder of the raw material alloy to collide against each other or collide the coarsely pulverized powder of the raw material alloy with a target or a container wall.

When finely pulverizing the coarsely pulverized powder of the raw material alloy, by adding a pulverization aid such as zinc stearate, urea, oleic amide, and the like, the finely pulverized powder with high orientation can be obtained in a compacting step. Also, by regulating the added amount of the pulverization aid, C content, N content, and the like of the R-T-B based permanent magnet obtained at the end can be regulated.

[Compacting Step]

The finely pulverized powder is compacted into a desired shape (compacting step). The compacting step is carried out by filling the finely pulverized powder in a mold held between electromagnets and then applying pressure, thereby forms a desired shape. By applying pressure while applying a magnetic field, a predetermined orientation of the finely pulverized powder is formed, and compacting is done in the magnetic field while crystal axis is oriented. Thereby, the green compact is obtained. The obtained green compact is oriented in a specific direction; hence the R-T-B based permanent magnet having a high magnetic anisotropy is obtained.

Pressure of 30 MPa to 300 MPa may be applied during compacting. Magnetic field of 950 kA/m to 1600 kA/m may be applied. The applied magnetic field is not limited to a static magnetic field, and it can be a pulse magnetic field. The static magnetic field and the pulse magnetic field can be used together.

As a compacting method, other than dry compacting in which the finely pulverized powder is directly compacted as described in above, wet compacting can be applied in which a slurry obtained by dispersing the finely pulverized powder in a solvent such as oil is compacted.

The shape of the green compact obtained by compacting the finely pulverized powder is not particularly limited, and for example, it can be any shape depending on the desired shape of the R-T-B based permanent magnet such as a rectangular parallelepiped shape, a tabular shape, a columnar shape, a ring shape, and the like.

[Sintering Step]

The green compact having a desired shape obtained by compacting in a magnetic field is sintered in a vacuum or in inert gas atmosphere, and the R-T-B based permanent magnet is obtained (sintering step). A sintering temperature needs to be regulated depending on various conditions such as a composition, a pulverization method, a difference between average particle size and particle size distribution, and the like. For example, sintering is done by heating the green compact in vacuum or in inert gas atmosphere at 1000° C. or higher and 1200° C. or lower for 1 hour or more to 48 hours or less. Thereby, the finely pulverized powder undergoes a liquid phase sintering, and the R-T-B based permanent magnet (a sintered body of the R-T-B based permanent magnet) having improved volume ratio of the main phase grains can be obtained. After obtaining the sintered body by sintering the green compact, from the point of improving the production efficiency, the sintered body may be quenched.

[Aging Treatment Step]

After sintering the green compact, an aging treatment is performed to the R-T-B based permanent magnet (aging treatment step). After sintering, the obtained R-T-B based permanent magnet is maintained at a temperature lower than in the sintering step, thereby the aging treatment is performed to the R-T-B based permanent magnet. The condition of the aging treatment is regulated accordingly depending on the number of times of the aging treatment such as a two-step heating which heats for 10 minutes to 6 hours at a temperature of 700° C. or higher and 1000° C. or lower and further heating for 10 minutes to 6 hours at temperature of 500° C. to 700° C.; or a one-step heating which heats for 10 minutes to 6 hours at temperature around 600° C. By carrying out such aging treatment, the magnetic properties of the R-T-B based permanent magnet can be improved. Also, the aging treatment step may be carried out after a machining step which is described n below.

[Cooling Step]

After carrying out the aging treatment to the R-T-B based permanent magnet, it is quenched in Ar gas atmosphere (cooling step). Thereby, the R-T-B based permanent magnet according to the present embodiment can be obtained. The cooling rate is not particularly limited, and preferably it is 30° C./min or more.

[Machining Step]

The obtained R-T-B based permanent magnet may be machined into a desired shape depending on the needs (machining step). The method of machining may be, for example, a shaping process such as cutting, grinding, and the like; a chamfering process such as barrel polishing; and the like.

[Grain Boundary Diffusion Step]

The heavy rare earth elements may be further diffused to the grain boundaries of the machined R-T-B based permanent magnet (grain boundary diffusion step). A method of grain boundary diffusion is not particularly limited. For example, a compound including the heavy rare earth elements may be adhered on the surface of the R-T-B based permanent magnet by coating, deposition, and the like, and then the heat treatments may be carried out, thereby the grain boundary diffusion may be performed. The R-T-B based permanent magnet may be heat treated in the atmosphere including vapor of heavy rare earth elements, thereby the grain boundary diffusion may be performed. The R-T-B based permanent magnet can further enhance HcJ by performing the grain boundary diffusion.

[Surface Treatment Step]

The R-T-B based permanent magnet obtained by the above-mentioned steps may be further performed with a surface treatment such as a plating treatment, a resin coating treatment, an oxidizing treatment, a chemical treatment, and the like (surface treatment step).

In the present embodiment, the machining step, the grain boundary diffusion step, and the surface treatment step are performed, however, these steps do not necessarily have to be performed.

The R-T-B based permanent magnet according to the present embodiment obtained as such has good magnetic properties and also a wide sintering temperature range. As a result, the R-T-B based permanent magnet according to the present embodiment can be produced stably.

The R-T-B based permanent magnet obtained as such is suitably used as a magnet in, for example, a surface permanent magnet (SPM) type rotating machine with an magnet attached on the surface of a rotor, an interior permanent magnet (IPM) type rotating machine such as an inner rotor type brushless motor, a permanent magnet reluctance motor (PRM) and the like. Specifically, the R-T-B based permanent magnet according to the present embodiment is suitably used for a spindle motor for a hard disk rotating drive or a voice coil motor in a hard disk drive, a motor for an electric vehicle or a hybrid car, a motor for an electric power steering motor in an automobile, a servo motor for a machine tool, a motor for a vibrator in a mobile phone, a motor for a printer, a motor for generator, and the like.

The present invention is not limited to the above described embodiment and can be variously modified within the scope of the present invention.

EXAMPLES

Hereinafter, the present invention is described based on further detailed examples, however, the present invention is not limited thereto.

A raw material alloy was prepared by a strip casting method to obtain a permanent magnet having a magnet composition shown in Table 1. Note that, unit of a content of each element shown in Table 1 is mass %.

Next, hydrogen was stored into the raw material alloy at room temperature, then a hydrogen pulverization treatment was performed which carried out 3 hours of dehydrogenation at 600° C. in vacuum (coarse pulverization), thereby an alloy powder (coarsely pulverized powder) was obtained. Then, the obtained alloy powder (coarsely pulverized powder) was left under an atmosphere of 5% oxygen concentration for 10 minutes to 6 hours, thereby oxygen content in each Example and Comparative example obtained at the end was regulated.

In the present examples, except for leaving the coarsely pulverized powder under the atmosphere of 5% oxygen concentration, each step (fine pulverization and compacting) from hydrogen pulverization treatment to sintering was performed under Ar atmosphere or in vacuum of oxygen concentration of less than 50 ppm.

Next, to the alloy powder, zinc stearate and urea were added as a pulverization aid and mixed using a Nauta mixer. Added amounts of zinc stearate ($(C_{18}H_{35}O_2)_2Zn$) and urea ($CH_4N_2O$) were regulated so that the oxygen content, carbon content, and nitrogen content of the R-T-B based permanent magnet obtained at the end were as shown in Table 1. Then, the fine pulverization was performed using a jet mill, thereby a finely pulverized powder having an average particle size of 3.0 μm or so was obtained.

The obtained finely pulverized powder was filled in a mold placed between electromagnets, a pressure of 120 MPa was applied while applying a magnetic field of 1200 kA/m, and a green compact was obtained by compacting in a magnetic field.

Then, the obtained green compact was sintered for five hours in vacuum, then it was quenched, thereby a sintered body having the magnet composition shown in Table 1 was obtained. In order to verify the sintering temperature range, seven rare earth permanent magnets were produced per each Example and Comparative example by changing the sintering temperature in 10° C. increments between the range of 1040° C. to 1100° C. Then, to the obtained sintered body, a two-step aging treatment which was 1 hour at 920° C. and 1 hour at 520° C. was performed, thereby the R-T-B based permanent magnet (R-T-B based sintered magnet) was obtained.

<Evaluation>

[Composition Analysis]

For the R-T-B based permanent magnet of each Example and Comparative example, a composition analysis was performed by X-ray fluorescence analysis, an inductively coupled plasma atomic emission spectroscopy (ICP analysis), and a gas analysis. The oxygen content was measured by an inert gas fusion-nondispersive infrared absorption method. The carbon content was measured by a combustion in oxygen stream-infrared absorption method. The nitrogen concentration was measured by an inert gas fusion-thermal conductivity method. As a result, it was confirmed that the composition of all of the R-T-B based permanent magnet satisfied the magnet composition shown in Table 1.

[Abnormal Grain Growth]

The R-T-B based permanent magnet of each sample was cut so that a cross section face is parallel with the direction of orientation. Then, SEM was used to the obtained cross section face to verify whether main phase grains having a grain size (circle equivalent) of 150 μm or more (abnormal grain) existed. For each Example and Comparative example, each of seven samples prepared by changing the sintering temperature in 10° C. increments between the range of 1040° C. to 1100° C. was verified whether the abnormal grain existed. Among the samples with the abnormal grain, the lowest sintering temperature was shown in Table 2 as the sintering temperature at which the abnormal grain growth occurred.

[Magnetic Properties]

As the squareness ratio of the R-T-B based permanent magnet of each Example and Comparative example, Hk/HcJ was measured using a B—H tracer. Hk of the present examples was the value of the magnetic field when the magnetization was Br×0.9. Among the samples having Hk/HcJ larger than 95%, the lowest sintering temperature was shown in Table 2 as the sintering temperature satisfying Hk/HcJ>95%.

[Sintering Temperature Range]

For each Example and Comparative example, a temperature range satisfying Hk/HcJ>95% without having abnormal grain growth was indicated in Table 2 as a sintering capable temperature. A value obtained by subtracting the lowest temperature from the highest temperature of the sintering capable temperature was indicated in Table 2 as a sintering temperature range. The sintering temperature range of 20° C. or larger was considered good, and the sintering temperature range of 40° C. or larger was considered even better. When all of the seven samples which were produced by changing the sintering temperature did not have abnormal grains, the highest temperature of the sintering capable temperature was set to 1100° C. for convenience.

[Microstructure Analysis]

Among Examples and Comparative examples, the R-T-B based permanent magnet sintered at the sintering capable temperature was cut and polished. Then, an element distribution of the obtained cross section was analyzed using SEM (SU-5000 made by Hitachi High-Technologies Corporation) and EDS (EMAX Evolution made by HORIBA, Ltd) at a magnification of 2500× and an observation field of 36 μm×50 μm. Among the obtained cross sections, the analysis was performed to two different observation fields.

Whether the Zr—B compound was included in the two-grain boundary was determined by verifying the Zr—B compound existing in either of the above mentioned two observation fields. Whether the Zr—C compound was substantially included was determined by verifying the Zr—C compound existing in the grain boundaries in the above mentioned two observation fields. In other words, the content ratio of the Zr—C compound was verified whether it was below an observation limit by the above-mentioned method. When the Zr—C compound did not exist in both of the two observation fields, it was considered that the Zr—C compound was not substantially included. Results are shown in Table 2.

An element mapping was performed to the above-mentioned two observation fields to verify the R—O—C—N concentrated part and the R—Ga—Co—Cu—N concentrated part. Results are shown in Table 2.

TABLE 1

| Samle No. | Example/ Comparative example | R | Nd | Pr | Co | B | M | Cu | Al | Zr | Ga | Mn | O | C | N |
|---|---|---|---|---|---|---|---|---|---|---|---|---|---|---|---|
| 1 | Example | 31.7 | 25.7 | 6.0 | 0.39 | 0.90 | 1.72 | 0.55 | 0.10 | 0.22 | 0.82 | 0.03 | 0.202 | 0.076 | 0.054 |
| 2 | Example | 31.7 | 25.7 | 6.0 | 0.44 | 0.90 | 1.97 | 0.80 | 0.10 | 0.22 | 0.82 | 0.03 | 0.202 | 0.076 | 0.054 |
| 3 | Comparative example | 31.7 | 25.7 | 6.0 | 0.87 | 0.90 | 2.36 | 1.19 | 0.10 | 0.22 | 0.82 | 0.03 | 0.202 | 0.076 | 0.054 |
| 4 | Comparative example | 31.6 | 25.6 | 6.0 | 0.38 | 0.78 | 1.71 | 0.55 | 0.10 | 0.22 | 0.81 | 0.03 | 0.201 | 0.076 | 0.053 |
| 5 | Example | 31.6 | 25.6 | 6.0 | 0.38 | 0.85 | 1.71 | 0.55 | 0.10 | 0.22 | 0.81 | 0.03 | 0.201 | 0.089 | 0.053 |
| 1 | Example | 31.7 | 25.7 | 6.0 | 0.39 | 0.90 | 1.72 | 0.55 | 0.10 | 0.22 | 0.82 | 0.03 | 0.202 | 0.076 | 0.054 |
| 6 | Example | 31.8 | 25.8 | 6.0 | 0.39 | 0.96 | 1.72 | 0.55 | 0.10 | 0.22 | 0.82 | 0.03 | 0.202 | 0.068 | 0.054 |
| 7 | Comparative example | 31.7 | 25.7 | 6.0 | 0.39 | 0.90 | 1.72 | 0.55 | 0.10 | 0.22 | 0.82 | 0.03 | 0.202 | 0.064 | 0.054 |
| 8 | Example | 31.7 | 25.7 | 6.0 | 0.39 | 0.90 | 1.72 | 0.55 | 0.10 | 0.22 | 0.82 | 0.03 | 0.202 | 0.073 | 0.054 |
| 1 | Example | 31.7 | 25.7 | 6.0 | 0.39 | 0.90 | 1.72 | 0.55 | 0.10 | 0.22 | 0.82 | 0.03 | 0.202 | 0.076 | 0.054 |
| 9 | Example | 31.8 | 25.8 | 6.0 | 0.39 | 0.90 | 1.72 | 0.55 | 0.10 | 0.22 | 0.82 | 0.03 | 0.203 | 0.105 | 0.054 |
| 10 | Example | 31.8 | 25.8 | 6.0 | 0.39 | 0.90 | 1.72 | 0.55 | 0.10 | 0.22 | 0.82 | 0.03 | 0.203 | 0.202 | 0.054 |
| 11 | Comparative example | 31.8 | 25.8 | 6.0 | 0.39 | 0.90 | 1.72 | 0.55 | 0.10 | 0.22 | 0.82 | 0.03 | 0.203 | 0.249 | 0.054 |
| 12 | Example | 31.7 | 25.7 | 6.0 | 0.39 | 0.90 | 1.72 | 0.55 | 0.10 | 0.22 | 0.82 | 0.03 | 0.202 | 0.076 | 0.023 |
| 1 | Example | 31.7 | 25.7 | 6.0 | 0.39 | 0.90 | 1.72 | 0.55 | 0.10 | 0.22 | 0.82 | 0.03 | 0.202 | 0.076 | 0.054 |
| 13 | Example | 32.0 | 25.9 | 6.1 | 0.39 | 0.90 | 1.72 | 0.55 | 0.10 | 0.22 | 0.82 | 0.03 | 0.203 | 0.077 | 0.096 |
| 14 | Comparative example | 31.7 | 25.7 | 6.0 | 0.39 | 0.90 | 1.72 | 0.55 | 0.10 | 0.22 | 0.82 | 0.03 | 0.108 | 0.076 | 0.054 |
| 1 | Example | 31.7 | 25.7 | 6.0 | 0.39 | 0.90 | 1.72 | 0.55 | 0.10 | 0.22 | 0.82 | 0.03 | 0.202 | 0.076 | 0.054 |
| 15 | Example | 31.8 | 25.8 | 6.0 | 0.39 | 0.89 | 1.72 | 0.55 | 0.10 | 0.22 | 0.82 | 0.03 | 0.367 | 0.077 | 0.054 |

TABLE 2

| Sample No. | Example/ Comparative example | Sintering Temp. satisfying Hk/HcJ > 95% | Sintering Temp. at which abnormal grain growth occurs | Sintering capable Temp. | Sintering temp. range (° C.) | Zr—B compound | Zr—C compound | R—O—C—N concentrated part | R—Ga—Co—Cu—N concentrated part |
|---|---|---|---|---|---|---|---|---|---|
| 1 | Example | 1040° C. | 1100° C. | 1040~1090° C. | 60 | Existed | Not found | Existed | Existed |
| 2 | Example | 1040° C. | 1100° C. | 1040~1090° C. | 60 | Existed | Existed | Existed | Existed |
| 3 | Comparative example | 1040° C. | 1060° C. | 1040~1050° C. | 10 | Not found | Existed | Existed | Not found |
| 4 | Comparative example | 1070° C. | 1080° C. | 1070° C. | 0 | Not found | Existed | Existed | Existed |
| 5 | Example | 1060° C. | 1090° C. | 1060~1080° C. | 30 | Existed | Existed | Existed | Existed |
| 6 | Example | 1040° C. | 1100° C. | 1040~1090° C. | 60 | Existed | Existed | Existed | Existed |
| 7 | Comparative example | 1060° C. | 1080° C. | 1060~1070° C. | 10 | Not found | Not found | Not found | Existed |
| 8 | Example | 1050° C. | 1090° C. | 1050~1080° C. | 40 | Existed | Existed | Existed | Existed |
| 9 | Example | 1040° C. | 1090° C. | 1050~1080° C. | 40 | Existed | Existed | Existed | Existed |
| 10 | Example | 1040° C. | 1080° C. | 1040~1070° C. | 40 | Existed | Existed | Existed | Existed |
| 11 | Comparative example | 1040° C. | 1050° C. | 1040° C. | 0 | Not found | Existed | Existed | Existed |
| 12 | Example | 1040° C. | 1090° C. | 1040~1080° C. | 50 | Existed | Existed | Existed | Existed |
| 13 | Example | 1050° C. | No abnormal grain growth | 1050~1100° C. | 60 | Existed | Existed | Existed | Existed |
| 14 | Comparative example | 1040° C. | 1050° C. | 1040° C. | 0 | Not found | Existed | Not found | Existed |
| 15 | Example | 1060° C. | No abnormal grain growth | 1060~1100° C. | 50 | Existed | Not found | Existed | Existed |

As shown in Table 1 and Table 2, Examples satisfying contents of all components within a specific range had a larger Hk/HcJ than 95% even when sintering was performed at a low temperature. Also, the abnormal grain growth did not occur even when sintering was performed at a high temperature. That is, the sintering temperature range was widened.

On the other hand, Comparative examples in which content of at least one of the components being out of the specific range had a narrow sintering temperature range.

Also, regarding Sample No. 2, a result of point analysis of the main phase grains and the R—O—C—N concentrated part using SEM and EDS are shown in Table 3. According to Table 3, the R—O—C—N concentrated part had higher contents of R, O, C, and N than in the main phase grains.

TABLE 3

| Atom % | Main phase grains | R—O—C—N concentrated parts |
|---|---|---|
| B | 3.56 | 0.00 |
| C | 22.29 | 31.29 |
| N | 0.00 | 10.04 |
| O | 1.22 | 23.19 |
| Al | 0.22 | 0.02 |
| Fe | 61.68 | 1.85 |
| Co | 0.52 | 0.00 |
| Cu | 0.15 | 0.02 |
| Ga | 0.56 | 0.33 |
| Zr | 0.02 | 0.00 |
| R | 9.78 | 33.26 |
| Pr | 1.86 | 6.63 |
| Nd | 7.92 | 26.63 |
| O/R | 0.12 | 0.70 |

NUMERICAL REFERENCES

1 . . . R-T-B based permanent magnet
3 . . . Main phase grains
11 . . . Zr—B compound
13 . . . R—Ga—Co—Cu—N concentrated part
15 . . . R—O—C—N concentrated part

What is claimed is:

1. An R-T-B based permanent magnet in which R is one or more rare earth elements, T is a combination of Fe and Co, and B is boron, wherein the R-T-B based permanent magnet comprises M, O, C, and N, M is three or more selected from Cu, Ga, Mn, Zr, and Al, and M at least comprises Cu, Ga, and Zr, with respect to 100 mass % of the R-T-B based permanent magnet, a total content of R is 29.0 mass % or more and 33.5 mass % or less, Co content is 0.10 mass % or more and 0.49 mass % or less, B content is 0.80 mass % or more and 0.96 mass % or less, a total content of M is 0.63 mass % or more and 4.00 mass % or less, Cu content is 0.51 mass % or more and 0.97 mass % or less, Ga content is 0.12 mass % or more and 1.07 mass % or less, Zr content is 0.80 mass % or less (does not include 0 mass %), C content is 0.065 mass % or more and 0.200 mass % or less, N content is 0.023 mass % or more and 0.323 mass % or less, O content is 0.201 mass % or more and 0.367 mass % or less, Fe is a substantial balance, and the R-T-B based permanent magnet includes main phase grains made of $R_2T_{14}B$ compound and a two-grain boundary which is a grain boundary formed between two adjacent main phase grains, and a Zr—B compound is included in the two-grain boundary.

2. The R-T-B based permanent magnet according to claim 1 further including an R—O—C—N concentrated part.

3. The R-T-B based permanent magnet according to claim 1 further including an R—Ga—Co—Cu—N concentrated part.

4. The R-T-B based permanent magnet according to claim 2 further including an R—Ga—Co—Cu—N concentrated part.

5. The R-T-B based permanent magnet according to claim 1 which does not substantially include a Zr—C compound.

6. The R-T-B based permanent magnet according to claim 2 which does not substantially include a Zr—C compound.

7. The R-T-B based permanent magnet according to claim 3 which does not substantially include a Zr—CC compound.

8. The R-T-B based permanent magnet according to claim 4 which does not substantially include a Zr—C compound.

9. The R-T-B based permanent magnet according to claim 1, wherein B content is 0.85 mass % or more and 0.96 mass % or less.

10. The R-T-B based permanent magnet according to claim 1, wherein Mn content is 0.02 mass % or more and 0.08 mass % or less.

* * * * *